US009721707B2

(12) United States Patent
Oomen

(10) Patent No.: US 9,721,707 B2
(45) Date of Patent: Aug. 1, 2017

(54) SUPERCONDUCTING COIL DEVICE HAVING A COIL WINDING

(71) Applicant: SIEMENS AKTIENGESELLSCHAFT, München (DE)

(72) Inventor: Marijn Pieter Oomen, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 196 days.

(21) Appl. No.: 14/439,617

(22) PCT Filed: Oct. 10, 2013

(86) PCT No.: PCT/EP2013/071152
§ 371 (c)(1),
(2) Date: Apr. 29, 2015

(87) PCT Pub. No.: WO2014/067759
PCT Pub. Date: May 8, 2014

(65) Prior Publication Data

US 2015/0279533 A1 Oct. 1, 2015

(30) Foreign Application Priority Data

Oct. 31, 2012 (DE) ..... 10 2012 219 899

(51) Int. Cl.
*H01F 6/06* (2006.01)
*H01F 41/04* (2006.01)
*H01F 6/04* (2006.01)

(52) U.S. Cl.
CPC ..... *H01F 6/06* (2013.01); *H01F 6/04* (2013.01); *H01F 41/048* (2013.01)

(58) Field of Classification Search
CPC ..... H01F 6/04; H01F 41/048
See application file for complete search history.

(56) References Cited

U.S. PATENT DOCUMENTS 8,655,423 B2 * 2/2014 Miyazaki ..... H01F 6/06 505/211
2012/0122697 A1 * 5/2012 Miyazaki ..... H01F 6/06 505/211

FOREIGN PATENT DOCUMENTS

DE 2434451 A1 1/1976
DE 102011118465 A1 5/2012
(Continued)

OTHER PUBLICATIONS

Office Action for German Application No. 102012219899.7 dated Mar. 22, 2013.
(Continued)

*Primary Examiner* — Colleen Dunn
(74) *Attorney, Agent, or Firm* — Slayden Grubert Beard PLLC

(57) ABSTRACT

A plurality of windings in a coil winding of a superconducting coil device includes at least one superconducting strip conductor that has a strip-shaped substrate strip and a superconducting layer arranged on the substrate strip. The coil device is subdivided into a plurality of segments in which adjacent windings are cast or adhered together within each segment, adjacent windings being, at most, weakly connected or adhered together in at least one sub-region, in the intermediate region between two adjacent segments.

20 Claims, 3 Drawing Sheets

(56) References Cited

FOREIGN PATENT DOCUMENTS

| | | |
|---|---|---|
| DE | 102011077457 A1 | 12/2012 |
| JP | 2010-267835 | 11/2010 |

OTHER PUBLICATIONS

International Search Report for PCT/EP2013/071152 mailed Feb. 25, 2014.

* cited by examiner

SUPERCONDUCTING COIL DEVICE HAVING A COIL WINDING

CROSS REFERENCE TO RELATED APPLICATIONS

This application is the U.S. national stage of International Application No. PCT/EP2013/071152, filed Oct. 10, 2013 and claims the benefit thereof. The International Application claims the benefit of German Application No. 102012219899.7 filed on Oct. 31, 2012, both applications are incorporated by reference herein in their entirety.

BACKGROUND

Described below is a coil device having a coil winding formed of a superconducting tape conductor.

In the field of superconducting machines and superconducting magnet coils, coil devices in which superconducting wires or tape conductors are wound in coil windings are known. For classical low-temperature superconductors such as NbTi and $Nb_3Sn$, conductors in wire form are conventionally used. High-temperature superconductors or high-$T_a$ superconductors (HTS), however, are superconducting materials with a critical temperature above 25 K, and for some material classes above 77 K. These HTS conductors are typically in the form of flat tape conductors formed of a strip-shaped substrate tape and a superconducting layer arranged on the substrate tape. In addition, the tape conductors often also have further layers such as stabilization layers, buffer layers, and in many cases also insulation layers.

The most important material class of so-called second-generation HTS conductors (2G HTS) is compounds of the type $REBa_2Cu_3O_x$, where RE stands for a rare earth element or a mixture of such elements. Many superconducting tape conductors formed of such ceramic superconducting layers are very sensitive to mechanical loads and must therefore be protected from mechanical loads, such as tensile, compressive or shear stresses, both during production and during operation of the superconducting coils.

When electrical coils are produced from superconducting tape conductors, either successive windings of the tape conductors are typically already adhesively bonded to one another by an impregnating resin during winding or the finished wound coil is subsequently encapsulated with an encapsulation medium. Typical encapsulation media in this case are epoxy resins, with which the coil may for example be encapsulated by a vacuum encapsulation method. The effect of the adhesive bonding or the encapsulation of the coil windings is that the finished coil is protected from mechanical loads, for example due to Lorentz forces in strong magnetic fields and/or due to centrifugal forces in the case of rapid rotation.

One problem with the use of superconducting coils is the different thermal contraction of the various materials in the coils when cooling to operating temperature. During cooling to an operating temperature of for example from 30 K to 70 K, above all the polymer constituents of the adhesive and/or of the encapsulation compound, as well as insulator materials possibly present, are subject to greater thermal shrinkage than the metallic and ceramic constituents of the tape conductor. The different thermal contraction leads during and after cooling to the formation of stresses, which may cause damage of the superconducting layer. The use of a winding carrier having thermal contraction greater than that of the tape conductor may also cause the formation of radial tensile stresses perpendicular to the plane of the tape conductor, and therefore compression of the superconducting layer. Above all, radial tensile stresses lead much more easily than possible radial compressive stresses to damage of the superconducting properties, possibly to the extent of delamination of the superconducting layer from the substrate of the tape conductor. A radial tension causes inner-lying layers of the coil winding to be pulled in the direction of the inside of the coil, and therefore causes the tape conductor to be compressed in the longitudinal direction. The damage due to this can lead to a reduction of up to 60% in the maximum operating current, which makes the conventional winding methods for superconducting coils incompatible with modern 2G HTS materials.

The application with the official file reference 102011077457.2, not yet published at the priority date of the present application, describes a coil superconducting winding in which a superconducting tape conductor is wound on a winding carrier in such a way that there is a positive radial pressure between the layers of the coil winding both at room temperature and at an operating temperature of the coil. This can be achieved by suitable selection of the winding carrier and of the winding tension, as well as by a weakly configured connection of the winding and the winding carrier. Nevertheless, even with a correspondingly produced coil in which the winding carrier does not contribute to the formation of tensile stresses, unfavorable tensile stresses can occur merely because of the differences in the thermal contractions of the various materials in the winding. Particularly in the case of large windings having more than for example 100 turns, large tensile stresses which greatly impair the superconducting properties of the coil can occur because of this effect.

SUMMARY

The superconducting coil device described below avoids the aforementioned disadvantages.

The coil device has at least one superconducting tape conductor, which has a strip-shaped substrate tape and a superconducting layer arranged on the substrate tape. The coil device is subdivided into a plurality of segments, neighboring turns within each segment being encapsulated together or adhesively bonded to one another, and, in the intermediate region between two neighboring segments, the neighboring turns being at most weakly connected or adhesively bonded to one another at least in a subregion.

The effect achieved by this is that the coil device described below has a substantially reduced radial tensile stress of the tape conductor during cooling to its operating temperature.

For suitable geometries and materials, the effect of the subdivision into segments is that the coil winding has a substantially reduced tensile stress in the tape conductor at its operating temperature, which advantageously lies in the range of the tensile stress which the tape conductor of a coil with the number of turns of an individual segment would have. The invention is thus based on the discovery that the stress caused by thermal shrinkage increases with the number of turns, and that this increase can be reduced by subdivision into weakly connected segments. The operating temperature of the superconductor lies, for example, between 25 K and 77 K.

Advantageous configurations and refinements of the coil device may be found in the following additional features:

In the intermediate region between two neighboring segments, the neighboring turns can be connected by an adhesive so weak that the connection is broken at a stress below 10 MPa at least in a subregion. In this embodiment, the weak connection in the subregion is configured in such a way that a radial tensile stress occurring when the superconductor is cooled to its operating temperature causes the connection in this subregion to break before the tensile stress can cause damage or even delamination of the superconducting layer. Advantageously, the connection can already break at 5 MPa, particularly advantageously at 3 MPa. Currently used 2G HTS materials can withstand a tensile stress of a few MPa.

In the intermediate region between two neighboring segments, at least one subregion in the intermediate space between neighboring turns can be free of adhesive bonding or encapsulation compound. If the neighboring turns of the segments in the subregion are thus not actually connected in this embodiment, the segments in this subregion can deform independently of one another from the start. Even in the case of small radial tensile stresses, the individual segments behave at least in the subregions as individual units that thermally shrink independently of one another.

In another embodiment, the coil device may have an encapsulation compound which encloses the neighboring turns within the segment. This encapsulation compound may advantageously be an epoxide. The same encapsulation compound may also be present between the segments in those sections which lie outside the subregions having at most weakly connected neighboring turns.

In another embodiment, the coil device may have a coating of a separating medium or an inlaid tape of a separating medium at least in a subregion in the intermediate region between two neighboring segments. The coating or the inlaid tape of a separating medium then advantageously prevents wetting with the encapsulation compound or the adhesive in these regions, so that then the encapsulation or adhesive bonding is either fully prevented or the adhesive bonding is only extremely weak compared with other regions of the winding. The separating medium may advantageously be PTFE.

In another embodiment, in the intermediate region between two neighboring segments, the tape conductor may be provided at least in a subregion with an additional layer which is formed from a material having a thermal expansion coefficient lower than the effective thermal expansion coefficient of the tape conductor. It is advantageous for the thermal shrinkage of the additional layer due to cooling to the operating temperature to be less than 0.3%, particularly advantageously less than 0.1%. In this embodiment, there is no cavity between the neighboring segments in the subregion, since the region between the unconnected or weakly connected tape conductors is now filled with the less strongly shrinking interlayer. This interlayer behaves in comparison with the other materials as an effectively expanding layer and thus has an increased relative space requirement during and after cooling. The effect of this is that no cavity is formed, and it therefore leads to greater mechanical stability of the coil winding after cooling. For example, the additional layer may be formed from graphite, which has a very low thermal expansion coefficient. Particularly advantageously, the material for the additional layer has a negative thermal expansion coefficient.

In another embodiment, in the intermediate region between two neighboring segments, the tape conductor may be provided at least in a subregion with an additional layer which is formed from a flexible material having a tensile strength of less than 10 MPa. In this embodiment, the tensions between the segments can be compensated for by yielding of the flexible material of the additional layer. If the neighboring tape conductors are still weakly connected in this region, the weak connection may then advantageously also remain after cooling. In this embodiment, the coil winding is mechanically more stable than with full absence of a connection and with the formation of cavities.

The coil winding may be configured as a racetrack coil or a rectangular coil.

If the coil winding is configured as a racetrack coil or as a rectangular coil, then a plurality of subregions having at most a weak connection of the neighboring turns of neighboring segments may lie within the curved regions of the racetrack or rectangular coil. In particular, the subregions with an at most weak connection may advantageously lie in the four corners of the racetrack or rectangular coil. This embodiment has the advantage that all the turns can be encapsulated together or adhesively bonded to one another on the straight sections of the coil, which form a large part of the overall length of the coil. This leads to a significantly improved mechanical stability of the coil winding. This embodiment is based on the discovery that the tensile stresses resulting from thermal shrinkage primarily occur in the curved regions, and can thus also be best reduced there by the subdivision into segments. In the straight sections of a rectangular or racetrack coil, the winding can shrink with relatively low stresses. This is comparable to the thermal shrinkage of a planar stack of tape conductors, in which the differences in the thermal expansion coefficients of the various materials can be compensated for by differently strong contraction in the tape conductor plane and perpendicularly to the tape conductor plane.

In an alternative embodiment, the subregions having at most a weak connection of the neighboring turns of neighboring segments may lie within the regions which form the curved regions of the coil winding and transition regions respectively adjacent on both sides. In this embodiment, straight transition regions, in which there is at most a weak connection between the segments and which adjoin the curved regions, are thus also provided. This offers the advantage that large radial tensile stresses also cannot occur because of the cooling where the strong connection of the segments changes to a weak connection of the segments. Bending of the tape conductor in the region where the strong connection of the segments changes to a weak connection of the segments is thus avoided.

In another embodiment, the coil winding may be configured as an approximately cylindrical winding and the segments may be configured as radial segments.

If the coil device is configured as a cylindrical winding with radial segments, then the subregions having at most a weak connection of the neighboring turns respectively extend at least over a full turn of 360 degrees. This embodiment offers the advantage that a radial tensile stress resulting between the segments from cooling can be compensated for as substantially as possible. The effective tensile relief due to the weak connection between the segments is particularly effective wherever the coil winding is curved, i.e. over the entire circumference of the winding in the case of a cylindrical coil.

In an alternative embodiment to this, the approximately cylindrical coil may be formed from straight regions and curved regions alternating with one another. Depending on the number of regions or winding segments present overall, the cylindrical shape then no longer exists, or exists less approximately. In this embodiment, the subregions having at most a weak connection of the neighboring turns of neighboring radial segments advantageously lie in the region of the curved regions. However, the possibility that the subregions having an at most weak connection extend in transition regions on both sides of the curved regions, so that bending of the tape conductor is advantageously avoided, is not intended to be excluded.

The superconducting layer of the coil device may include a second-generation high-temperature superconductor, in particular $ReBa_2Cu_3O_x$.

The coil device may include a cooling system, and the segments of the coil winding may respectively be coupled individually to the cooling system. This configuration is particularly advantageous when the segments are at most weakly connected to one another either over the entire circumference of the coil or over relatively large subregions. Then, it is particularly important to ensure that the individual segments are thermally coupled well to the cooling system for cooling to the operating temperature of the superconductor.

BRIEF DESCRIPTION OF THE DRAWINGS

These and other aspects and advantages will become more apparent and more readily appreciated with the aid of two exemplary embodiments described below with reference to the accompanying drawings of which.

DETAILED DESCRIPTION OF THE PREFERRED EMBODIMENT

Figure 1:
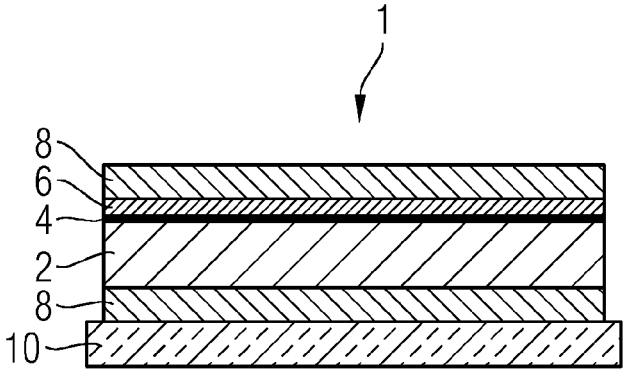
FIG. 1 is a schematic cross section of a superconducting tape conductor.

Reference will now be made in detail to the preferred embodiments, examples of which are illustrated in the accompanying drawings, wherein like reference numerals refer to like elements throughout.

FIG. 1 shows a cross section of a superconducting tape conductor 1, in which the layer structure is represented schematically. In this example, the tape conductor has a substrate tape 2, which in this case is a 100 μm thick substrate such as a nickel-tungsten alloy. As an alternative, steel tapes or tapes of an alloy, for example Hastelloy, may also be used. Arranged over the substrate tape 2, there is a 0.5 μm thick buffer layer 4, which here contains the oxide materials $CeO_2$ and $Y_2O_3$. This is followed by the actual superconducting layer 6, here a 1 μm thick layer of $YBa_2Cu_3O_x$, which is in turn covered with a 50 μm thick cover layer 8 of copper. As an alternative to the material $YBa_2Cu_3O_x$, it is also possible to use corresponding compounds $REBa_2Cu_3O_x$ of other rare earths RE. Arranged on the opposite side of the substrate tape 2, there is in this case a further 50 μm thick cover layer 8 of copper, followed by an insulator 10, which in this example is configured as a 25 μm thick Kapton tape. The insulator 10 may, however, also be made of other insulating materials, for example other plastics. In the example shown here, the width of the insulator 10 is somewhat greater than the width of the other layers of the tape conductor 1, so that turns $W_i$, $W_{i+1}$ that come to lie on one another when the coil device is being wound are reliably insulated from one another. As an alternative to the example shown, the tape conductor 1 may also have insulator layers on both outer surfaces, or the lateral regions of the superconducting tape conductor 1 may additionally be protected by insulating layers. It is furthermore possible to wind an insulator tape into the coil device as a separate tape during the actual production of the coil winding. This is particularly advantageous when a plurality of tape conductors, which do not need to be insulated from one another, are wound in parallel. Then, for example, an assembly of from 2 to 6 tape conductors lying above one another without their own insulating layer may be wound together with an additionally inlaid insulator tape in common turns.

Typically, the substrate tape 2, the buffer layer 4, the superconducting layer 6 and the cover layer 8 in their entirety experience a thermal contraction of about 0.3% when they are cooled from about 300 K to about 30 K. For known materials of the insulator 10 and of the epoxides used as an encapsulation compound or adhesive compound, the thermal contraction is however substantially higher, about 1.2%. In the case of planar stacks of tape conductors and on the straight sections of a coil winding, these differences can be compensated for by different shrinkages in the plane and perpendicularly to the plane of the tape conductor. In the curved regions, however, they lead to the formation of radial tensile stresses. In the following two exemplary embodiments, the way in which the radial tensile stresses can be reduced by the subdivision into segments is shown. It is particularly advantageous for the layers having a high thermal contraction in this case to be made as thin as possible, above all in the curved regions. Both exemplary embodiments below will be based on the tape conductor represented in FIG. 1 as the winding material. Here, at 25 μm, the insulator 10 is advantageously made relatively thin in comparison with the remaining overall thickness of the tape conductor 1.

Figure 2:
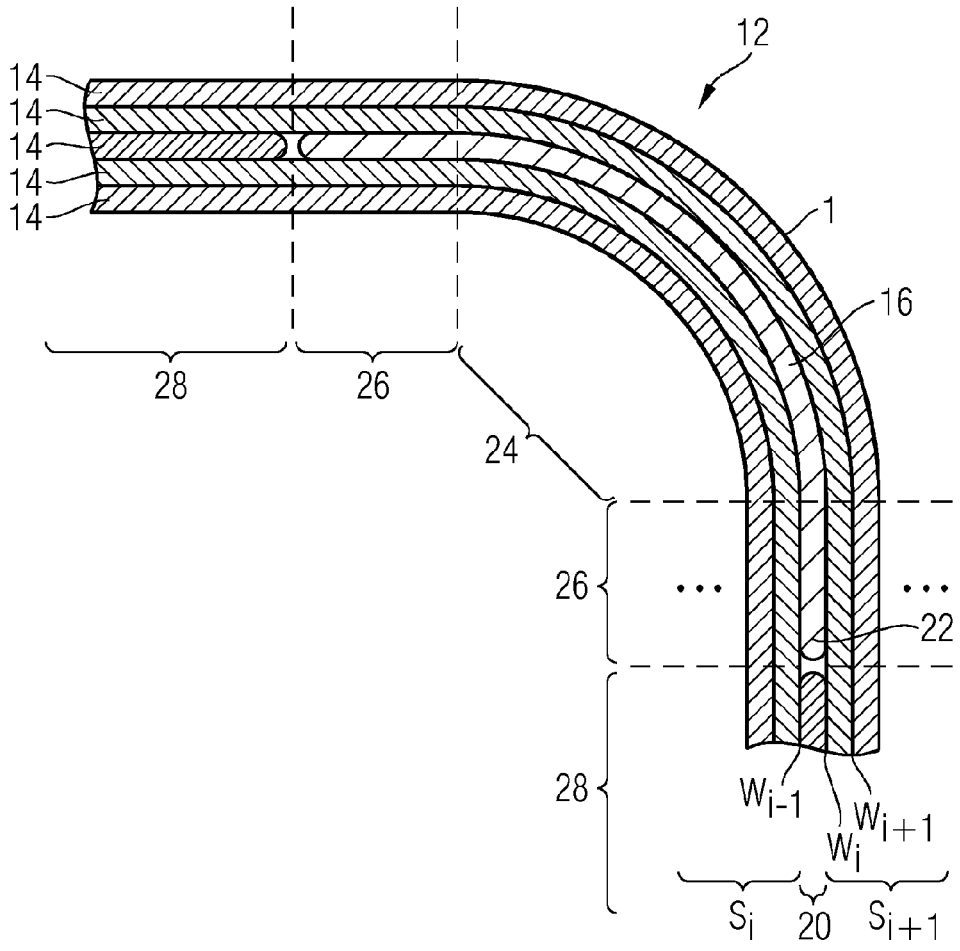
FIG. 2 is a cross section of a detail of a coil winding according to a first exemplary embodiment.

FIG. 2 shows a detail of a first coil winding 12 according to a first exemplary embodiment. In this example, the coil winding 12 is configured as a rectangular coil. The detail in FIG. 2 shows a region around the four curved corners of the rectangular coil. FIG. 2 in this case represents only a part of the coil winding 12, namely a section of the winding with six turns of tape conductors 1 lying above one another, each of which is constructed according to the example in FIG. 1. Three of the turns are part of an inner segment $S_i$, and three of the turns represented are part of an outer segment $S_{i+1}$. As indicated, each segment has more than the three turns represented by way of example. For example, each segment may have between 10 and 200 turns, particularly advantageously between 50 and 100 turns. The overall coil winding may for example have between 2 and 50 such segments, particularly advantageously between 5 and 10 segments. Inside each segment $S_i$, $S_{i+1}$, in this exemplary embodiment all the turns $W_i$ are encapsulated with an epoxide encapsulation compound 14. The encapsulation compound 14 in this exemplary embodiment was introduced by vacuum encapsulation after winding of the coil (so-called dry winding). As an alternative, an impregnating resin or an adhesive may also be introduced already during the winding of the coil winding (so-called wet winding), in which case the tape conductor is typically wetted on both sides with the impregnating resin or adhesive before the winding. In this exemplary embodiment, the neighboring turns $W_{i-1}$, $W_i$ are also encapsulated together in a plurality of subsections in the intermediate regions 20 between the segments $S_i$, $S_{i+1}$. Of the four straight subsections 28 of the rectangular coil, two are represented schematically in FIG. 2. Within these subsections 28, all the turns $W_i$ of the entire coil are firmly connected to one another by the encapsulation compound 14, including in the intermediate region 20 between two neighboring segments $S_i$, $S_{i+1}$. In the curved regions 24, of which the overall rectangular coil includes four, however, the neighboring turns $W_{-1}$, $W_i$ of different segments $S_i$, $S_{1+1}$ are not connected to one another by encapsulation compound 14. The same applies for the transition regions 26, adjacent to each curved region 24 on both sides, in which likewise no encapsulation compound 14 is arranged between the neighboring turns $W_{i-1}$, $W_i$ of different segments $S_i$, $S_{1+1}$. Instead, a PTFE tape 16 is inlaid in this entire subregion 22 between the segments $S_i$, $S_{i+1}$, which prevents this subregion 22 from being filled with encapsulation compound 14 during the encapsulation of the wound coil. In this example, the PTFE tape 16 has a layer thickness similar to the average thickness of the encapsulation compound introduced during the encapsulation, in this case a thickness of 25 μm. The inlaid PTFE tape 16 thus advantageously prevents adhesive bonding of the tape conductors 1 of neighboring turns $W_{i-1}$, $W_i$ to the encapsulation compound 14 in the subregion 22, so that the PTFE tape 16 laid inbetween is not wetted by the encapsulation compound 14. In this way, furthermore, the formation of a strong connection of the neighboring tape conductors 1 in this subregion 22 is avoided. In this exemplary embodiment, no chemical adhesive bond at all is formed in this subregion 22. As an alternative to this example, the tape conductor may also be coated with a separating medium, for example PTFE, in the subregion 22. Depending on the properties of the coating, either no adhesive bond at all or only a weak adhesive bond may then be formed between the neighboring tape conductors 1. As an alternative or in addition to the separating medium 16 represented here, a further layer may also be introduced in the intermediate region 20. Either the material of this further layer may have a low or even negative thermal expansion coefficient, and/or the layer may include a flexible material having a tensile strength of less than 10 MPa. In both configurations, the further layer contributes to reducing radial tensile stresses in the intermediate regions 20, and to increasing the mechanical strength of the coil in the curved regions 24 and the adjacent transition regions 26.

A feature common to all the variants described above is that the tensile stress on the turns $W_i$ of the entire coil is reduced by the at most weak connection of the neighboring tape conductors 1 in the subregions 22. Owing to the at most weak connection in these subregions 22, the maximum tensile strength on the tape conductor 1 due to thermal contraction of the various materials behaves approximately as in the case of a coil winding which only has the number of turns of an individual segment $S_1$. The rectangular coil of the exemplary embodiment shown has four relatively long straight regions 32 and four relatively short curved regions 24, respectively with transition regions 26 adjacent on both sides. Above all, mechanical decoupling and tensile relief of the segments in the curved regions 24 is effective for reduction of the tensile stress on the tape conductor. The rectangular coil may therefore be encapsulated entirely as in known methods in the straight regions 32, and therefore have a large part of the mechanical stability achieved by these methods. Advantageously, the at most weak connection of the neighboring tape conductors 1 between two neighboring segments $S_i$, $S_{i+1}$ is also present in transition regions 26 adjacent on both sides, in addition to the curved regions 24, so that excessively high tensile, compressive or shear stresses are not formed at the transition from the straight regions 32 into the curved regions 24 and at the transition from the strongly connected to the weakly connected intermediate regions.

Figure 3:
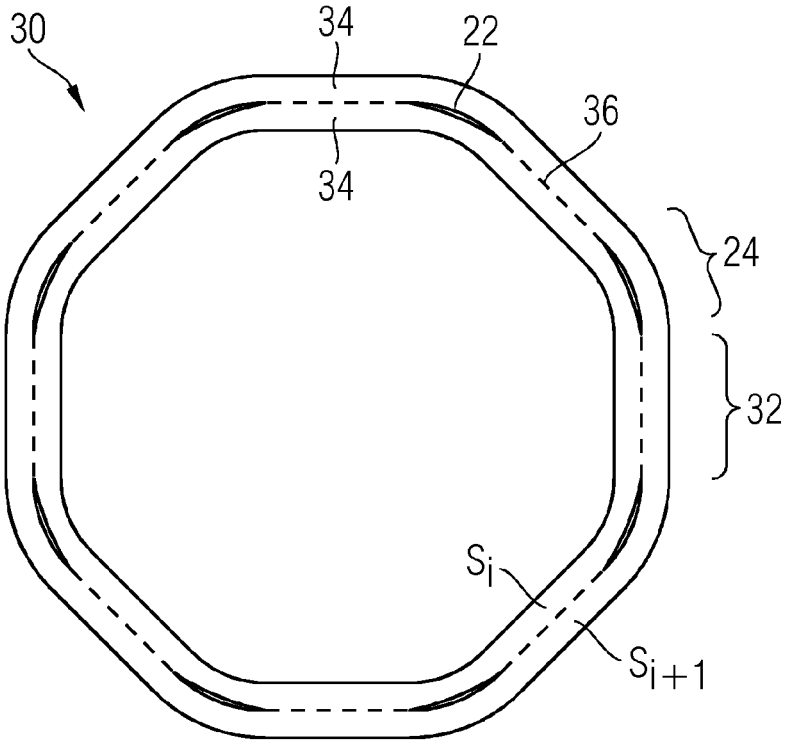
FIG. 3 is a coil winding according to a second exemplary embodiment in schematic plan view.

FIG. 3 shows a second coil winding 30 according to a second exemplary embodiment in schematic plan view. This second coil winding 30 is configured as an approximately cylindrical winding, in this example the cylindrical shape being formed only approximately from straight regions 32 and curved regions 24. In the example shown here, the coil winding respectively includes eight straight regions 22 and eight curved regions 24, although the number of individual regions may also be substantially greater. In the second exemplary embodiment shown, the coil winding has only two segments $S_i$ and $S_{i+1}$. The number of segments may however also be substantially greater, and it may for example be between 2 and 50 and particularly advantageously between 5 and 10. Throughout the encapsulated region 34 of the second exemplary embodiment shown, all neighboring turns are firmly connected to one another by encapsulation compound, even over the boundary 36 of the two segments. Only in the eight subregions 22 on the boundary 36 of the segments is the encapsulation compound between the neighboring tape conductors 1 interrupted. In this second exemplary embodiment, the tape conductors 1 adjacent to the subregions 22 are coated with the separating medium PTFE, which has a dewetting effect for the encapsulation compound and therefore leads to cavities without encapsulation compound being formed in the subregions 22. In the subregions 22, the neighboring tape conductors are therefore not connected to one another in this example, and the formation of the cavities particularly effectively leads to tensile relief of the radial tensile stresses occurring to an increased amount in the curved regions 24. Owing to the expansion or compression of the cavities when the temperature changes, both tensile and compressive stresses on the tape conductors 1 of the coil winding 30 can be reduced.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A superconducting coil device comprising:

a coil winding with a plurality of turns comprising a racetrack coil or a rectangular coil;

at least one superconducting tape conductor with a strip-shaped substrate tape and a superconducting layer arranged on the substrate tape;

the coil winding subdivided into a plurality of segments, neighboring turns within each segment being at least one of encapsulated together and adhesively bonded to one another, and, in an intermediate region between two neighboring segments, the neighboring turns being at most weakly connected or adhesively bonded to one another in at least in one subregion; and a plurality of subregions having at most a weak connection of the neighboring turns of neighboring segments lie within curved regions of the coil winding.

2. The coil device as claimed in claim 1, wherein, in the intermediate region between two neighboring segments, the neighboring turns are at most connected by an adhesive forming a connection breakable at a stress below 10 MPa in the at least one subregion.

3. The coil device as claimed in claim 1, wherein, in the intermediate region between two neighboring segments, the at least one subregion in the intermediate region between the neighboring turns is free of adhesive bonding or encapsulation compound.

4. The coil device as claimed in claim 1, further comprising an encapsulation compound enclosing the neighboring turns within the segment.

5. The coil device as claimed in claim 1, further comprising a coating of a separating medium or an inlaid tape of a separating medium in the at least one subregion in the intermediate region between two neighboring segments.

6. The coil device as claimed in claim 5, wherein, in the intermediate region between two neighboring segments, the tape conductor is provided in the at least one subregion with an additional layer formed from a material having a thermal expansion coefficient lower than an effective thermal expansion coefficient of the tape conductor.

7. The coil device as claimed in claim 6, wherein, in the intermediate region between two neighboring segments, the tape conductor is provided in the at least one subregion with an additional layer formed from a flexible material having a tensile strength of less than 10 MPa.

8. The coil device as claimed in claim 1, wherein, in the intermediate region between two neighboring segments, the tape conductor is provided in the at least one subregion with an additional layer formed from a material having a thermal expansion coefficient lower than an effective thermal expansion coefficient of the tape conductor.

9. The coil device as claimed in claim 1, wherein, in the intermediate region between two neighboring segments, the tape conductor is provided in the at least one subregion with an additional layer formed from a flexible material having a tensile strength of less than 10 MPa.

10. The coil device as claimed in claim 1, wherein the superconducting layer includes a second-generation high-temperature superconductor.

11. The coil device as claimed in claim 10, wherein the superconducting layer includes ReBa.sub.2Cu.sub.3O.sub.x.

12. A superconducting coil device, comprising:

a coil winding with a plurality of turns, the coil winding comprising a racetrack coil or a rectangular coil;

at least one superconducting tape conductor with a strip-shaped substrate tape and a superconducting layer arranged on the substrate tape;

the coil winding being subdivided into a plurality of segments, neighboring turns within each segment being at least one of encapsulated together and adhesively bonded to one another, and, in an intermediate region between two neighboring segments, the neighboring turns being at most weakly connected or adhesively bonded to one another in at least in one subregion;

a plurality of subregions having at most a weak connection of the neighboring turns of neighboring segments lie within curved regions of the coil winding and transition regions respectively adjacent on both sides;

wherein, in the intermediate region between two neighboring segments, the neighboring turns are at most connected by an adhesive forming a connection breakable at a stress below 10 MPa in the at least one subregion.

13. The coil device as claimed in claim 12, wherein, in the intermediate region between two neighboring segments, the at least one subregion in the intermediate region between the neighboring turns is free of adhesive bonding or encapsulation compound.

14. The coil device as claimed in claim 12, further comprising an encapsulation compound enclosing the neighboring turns within the segment.

15. The coil device as claimed in claim 12, further comprising a coating of a separating medium or an inlaid tape of a separating medium in the at least one subregion in the intermediate region between two neighboring segments.

16. The coil device as claimed in claim 15, wherein, in the intermediate region between two neighboring segments, the tape conductor is provided in the at least one subregion with an additional layer formed from a material having a thermal expansion coefficient lower than an effective thermal expansion coefficient of the tape conductor.

17. The coil device as claimed in claim 12, wherein, in the intermediate region between two neighboring segments, the tape conductor is provided in the at least one subregion with an additional layer formed from a material having a thermal expansion coefficient lower than an effective thermal expansion coefficient of the tape conductor.

18. The coil device as claimed in claim 12, wherein, in the intermediate region between two neighboring segments, the tape conductor is provided in the at least one subregion with an additional layer formed from a flexible material having a tensile strength of less than 10 MPa.

19. The coil device as claimed in claim 12, wherein the superconducting layer includes a second-generation high-temperature superconductor.

20. The coil device as claimed in claim 19, wherein the superconducting layer includes ReBa.sub.2Cu.sub.3O.sub.x.

* * * * *